United States Patent [19]

Paris et al.

[11] Patent Number: 4,914,839

[45] Date of Patent: Apr. 10, 1990

[54] SKI BOOT

[75] Inventors: Jean Paris, Sevrier; Claude Perrissoud, Saint-Jorioz, both of France

[73] Assignee: Salomon S.A., Annecy Cedex, France

[21] Appl. No.: 126,337

[22] Filed: Nov. 30, 1987

[30] Foreign Application Priority Data

Nov. 28, 1986 [FR] France ..... 86 17104

[51] Int. Cl.[4] ..... A43B 5/04

[52] U.S. Cl. ..... 36/119; 36/120; 128/611

[58] Field of Search ..... 36/117-121, 36/58.5; 128/611

[56] References Cited

U.S. PATENT DOCUMENTS

| | | | |
|---|---|---|---|
| 2,279,951 | 4/1942 | Morein | 128/611 |
| 4,510,703 | 4/1985 | Eiteljorg | 36/119 |
| 4,580,358 | 4/1986 | Pozzobon | 36/119 |
| 4,583,306 | 4/1986 | Paris | 36/119 |
| 4,638,578 | 1/1987 | Eiteljorg, II | 36/119 |

FOREIGN PATENT DOCUMENTS

| | | | |
|---|---|---|---|
| 0171685 | 7/1985 | European Pat. Off. . | |
| 855370 | 11/1952 | Fed. Rep. of Germany | 128/611 |
| 3247516 | 6/1984 | Fed. Rep. of Germany . | |
| 3429237 | 2/1986 | Fed. Rep. of Germany . | |
| 3506056 | 3/1986 | Fed. Rep. of Germany . | |
| 2343437 | 10/1977 | France . | |
| 2345097 | 10/1977 | France . | |
| 2556187 | 6/1985 | France . | |
| 2576192 | 7/1986 | France | 36/117 |
| 506960 | 6/1971 | Switzerland . | |
| WO87/05474 | 9/1987 | World Int. Prop. O. | 36/119 |

*Primary Examiner*—James Kee Chi

*Attorney, Agent, or Firm*—Pollock, Vande Sande & Priddy

[57] ABSTRACT

An arrangement for retaining a skier's foot within the shell base of a ski boot, comprising one or more tongues integral with the inner sides of the shell base, extending transversely to the longitudinal axis of the boot and at least partly surrounding the top of the foot. The tongues fold down along a drop line in a plane above the heads of the metatarsals and the malleoli, and are located between two planes secant to the plane of the boot sole and passing through the heads of these bones. Actuation of the tongues relative to the foot takes place from outside the boot.

23 Claims, 7 Drawing Sheets

19
9

21
20
10
1
II
15'
3,3'
15
22
17
12
6
II

18

23'
23
3'
3
6
15'
15
17
17
14'
14
7'
7
12

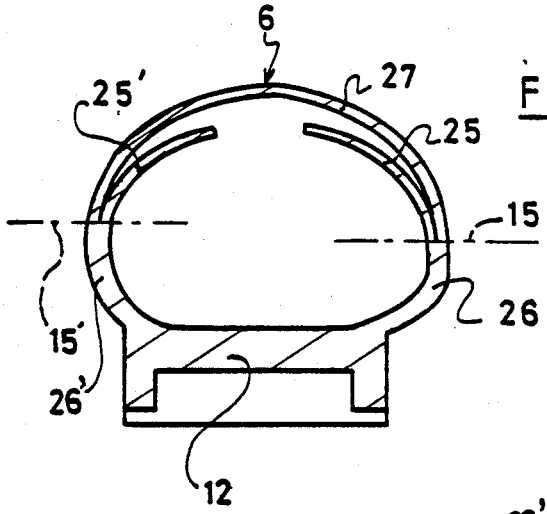
FIG 4
FIG 5
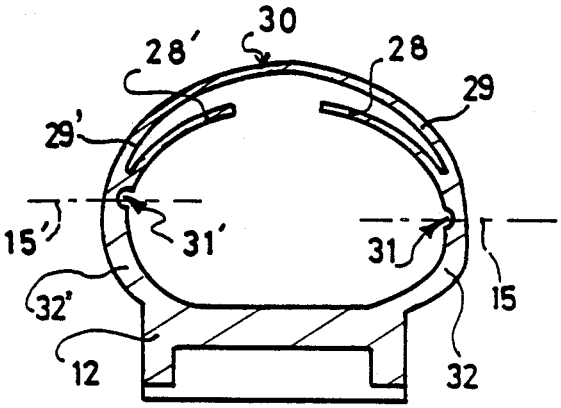
FIG 6
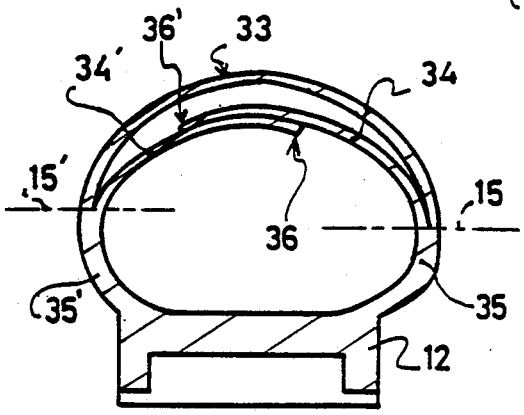
FIG 7
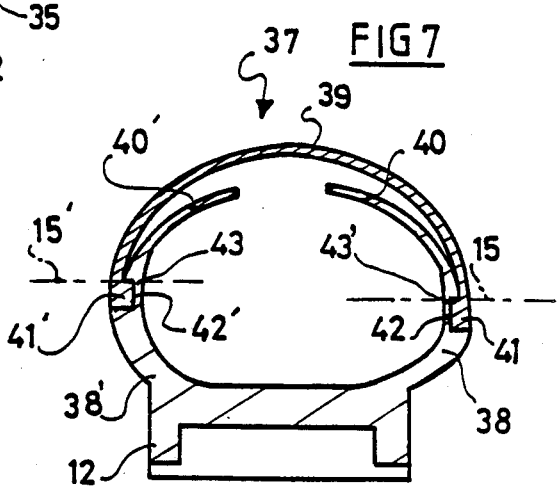

SKI BOOT

FIELD OF THE INVENTION

The invention concerns ski boots of the type having a rigid shell. In particular, it relates to the lower portion of such boots, the portion more commonly called the shell base, and to a special structure of elements for retaining and/or holding the skier's foot within said shell base.

BACKGROUND OF THE INVENTION

In a manner known per se, certain rigid-shell ski boots comprise a shell bottom under a boot upper consisting of a rear piece (or rear cover) and a front piece (or oversleeve) covering a longitudinal slit in the upper area of the shell base. Rearward traction, exerted when the top is closed over the skier's leg, draws the edges of the slit together over the skier's instep so as to hold the foot in the boot by deformation of the upper portion of the shell base. Such boots are described in German Patents Nos. DE 32 47 516 and DE 35 06 056.

Other types of boots also make use of foot-retention means contained within the shell base that act independently of any deformation in said shell base. Such examples are disclosed in French Patents Nos. 2,343,437 and 2,345,097. German Patent Application No. DE 34 29 237 describes another principle for gripping the foot through deformation of the shell base induced by traction exerted on cables passing over the flexible edges of the slit in the shell base by means of a tensioning system installed on the piece covering the front portion of the boot.

Finally, French Patent No. 2,556,187 describes a type of boot construction in which the tightening principle disclosed in French Patent No. 2,345,047 is applied to flexible sections anchored in the shell base itself and extending within a rigid, non-deformable structure of the front portion of the boot, covering the entire area of the boot from the tip to the instep.

The use and application of the boots described in German Patents Nos. DE 35 06 056 and DE 32 47 516 show that with this type of boot a base is required in order to ensure a leakproof boot, and that the edges of the slit must be made flexible enough to hold the foot effectively. It appears that these requirements are difficult to meet, since the top cover of such boots, which contributes to controlling the bendings of the leg of the skier, produces a relatively continuous movement of the cover with respect to the shell base in the course of skiing. This movement of the cover has as its consequence the alteration of the conditions under which the foot was initially retained.

Other boots, such as those disclosed in Swiss Patent No. 506,960, include a rigid shell provided with an opening and closing device through which the foot passes, while the foot is held by means of a fabric gaiter made integral with the insole and fastened to elastic retaining means that make use of cords and laces. In such shoes, all parts of the foot are subjected to the pressure of the retaining means; this is relatively awkward or even painful for certain parts of the foot such as the metatarsal-phallangian articulations, which undergo considerable changes in position across their width, especially when the skier changes position, changes which alter the distribution of weight on the foot.

Also known are safety boots in which the flexible upper is provided with conventional lacing means, such as those described in U.S. Pat. No. 3,798,804, and which comprise a rigid upper safety cover that pivots freely about an axis situated in the toe area. In this example, the boot is constructed with a number of transverse tongues fastened to the lacing means and interconnected by means of a flexible material so as not to interfere with the bending of the upper in walking. Such boots are able to hold feet well enough for walking, but the structure of the freely pivoting cover makes it impossible to ensure a leakproof ski boot that will absorb the forces exerted on the rigid shell base by the top of the boot.

SUMMARY OF THE INVENTION

The invention offers a ski boot having a foot-gripping capacity comparable to that provided by conventional, lace-up walking shoes while retaining the qualities of control and stress-absorption of rigid-shell ski boots. To this end, the invention joins internal foot retention means to the shell base, respecting the shape of the skier's foot without exerting stress or pressure on the bony areas of the joints of the forefoot and heel in particular, allowing said bony areas to change position Within the shell base. When the foot is subjected to the various stresses involved in the act of skiing.

The ski boot according to the invention comprises a rigid shell base below a boot upper equipped with an opening and closing system through which the skier's foot passes, said shell base at least partially enclosing the foot from its forward end back approximately to the area corresponding to the instep. The boot is characterized by the fact that at least one transverse tongue is made . and at least partially encircles the top of the skier's foot. The tongue can be drawn down with respect to the shell base along a drop line that is longitudinal to the boot, elevated with respect to the plane of the sole, and located in a plane that passes approximately over the heads of the metatarsal and malleolian bones of the foot. Along the length of the boot, the tongue is delimited by two secant planes intersecting the plane of the sole and passing through the heads of the malleolian and metatarsal bones, respectively.

Advantageously, the transverse tongue is flexible with respect to the wall of the shell base to Which it is joined. An internal foot-retention device, of a type known per se, is arranged so as to draw the tongue down against the top of the skier's foot without deforming the shell base or any other of the parts of the rigid shell (when the latter consists of several assembled parts).

Thus, according to a preferred embodiment of the invention, the foot-retention means, consisting of the tongue, are flexible with respect to the corresponding surface of the shell base beyond a delimiting line below which the shell base houses the bony parts of the calcaneum and the metatarsal heads of the skier's foot. It is understood that if the boot is built by joining the tongue to the wall of the shell base, the drop line of the transverse tongue may or may not be coextensive with the line along which it is attached to the shell base. It should also be noted that the entire area of the shell base (or of its structural equivalent) lying below the drop line of the transverse tongue is essentially rigid, so that the areas containing the heads of the foot bones are housed in a non-deformable casing within which a custom-fitted lining may be provided to envelop the foot comfortably. The transverse tongue is designed to grip the foot by enveloping its upper surface in a flexible manner.

The invention is not limited to the use of a single interior transverse tongue, but extends to all constructions using a series of tongues arranged on one or both sides of he boot. In such cases, the drop line of each tongue would be coextensive with the general drop line on each side of the boot.

The invention admits of many variants of the foot-retention means, or tongues. For example, the tongues may be made of a relatively flexible, supple, and/or expandable material. Depending on design requirements, these tongues may be joined by various assembly mean to the non-deformable walls of the shell base or may constitute an extension of said walls. Finally, the tongues may also include bend zones in the form of articulations and/or arrangements such as grooves, channels, and the like, capable of permitting bending from a certain line by altering the resistance of the materials used in those areas. To ensure optimal distribution of the gripping or holding pressures exerted by the tongues on the skier's foot, the tongues possess a certain degree of flexibility and/or special shapes or forms such as a plurality of notches or deformable sections capable of adapting to the shape of the foot.

The rigid portions of the shell of the boot may be constructed in different ways, depending among other things on the manner in which the boots are to be put on. Thus the shell base may be made of a single enveloping piece below a boot top comprising an oversleeve and a rear cover, with the latter being rearwardly pivotable in order to allow the skier to insert his or her foot. For a front-opening construction, the shell base may be provided with an upper cover, removable from, or articulated on, the shell base.

Regardless of the method of constructing or assembling the rigid sections of the boot shell, the foot-retention means (consisting of the transverse tongues) are arranged under said rigid sections within the delimited area and space set forth above, and at least one tightening and/or adjusting device is to bring said retaining means together, particularly by drawing their free ends together so as to apply them to the top of the foot.

It is obvious that a comfort lining could be placed between the tongues and the foot if desired.

BRIEF DESCRIPTION OF THE DRAWINGS

A better understanding of the invention will be gained from the following description, made with reference to the attached drawings, which illustrate, by way of example, several embodiments of boots produced in accordance with the invention.

FIG. 2 is a longitudinal section view of the boot, while FIG. 3 is a transverse section of the same boot along line II—II of FIG. 2.

FIGS. 4 to 11 are as transverse section views along line II—II of FIG. 2, showing other embodiments of foot-retention means internal to the boot and the means by which they are secured to the shell base.

FIG. 17 is a perspective view showing tightening of the ski boot by means of laces.

DESCRIPTION OF PREFERRED EMBODIMENTS

Figure 1:
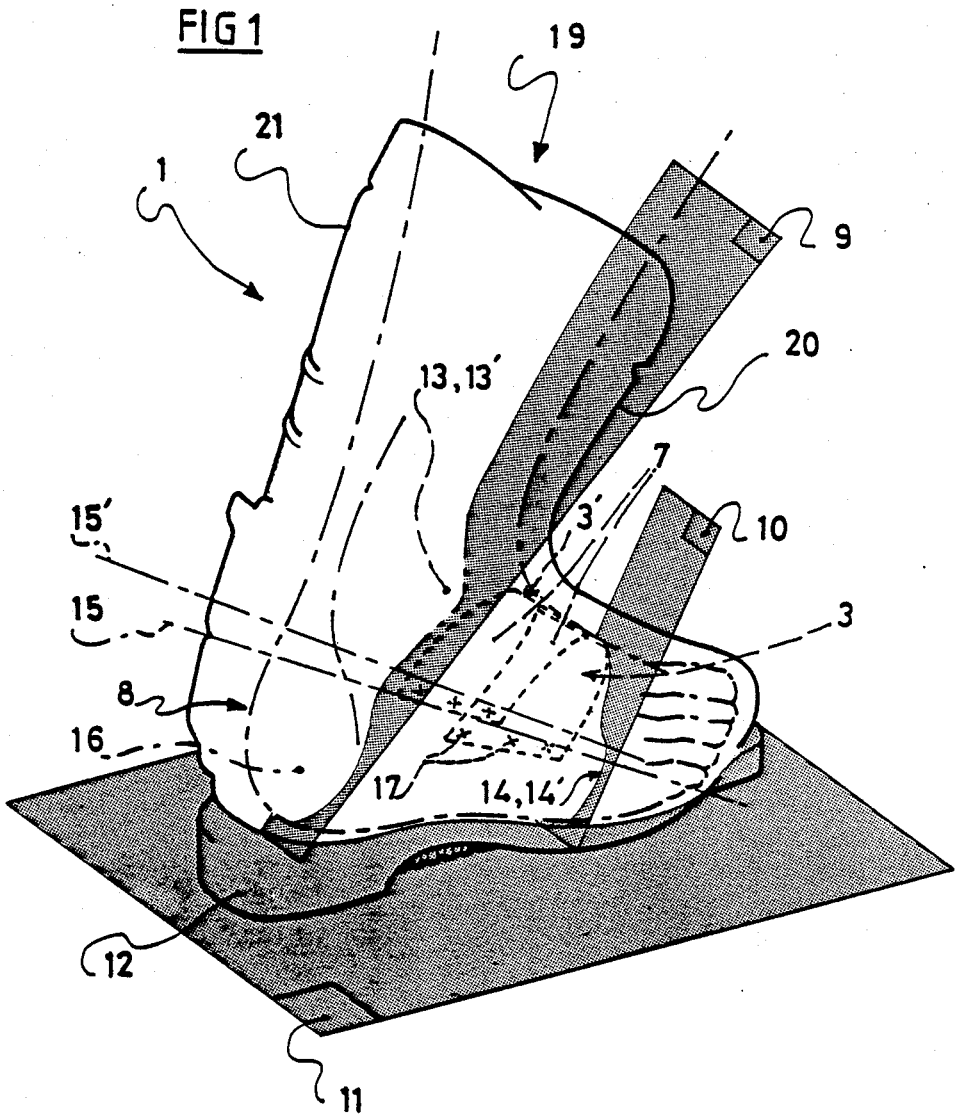
FIG. 1 is a schematic illustration of a ski boot provided with internal foot-retention means according to the invention.
Figure 2:
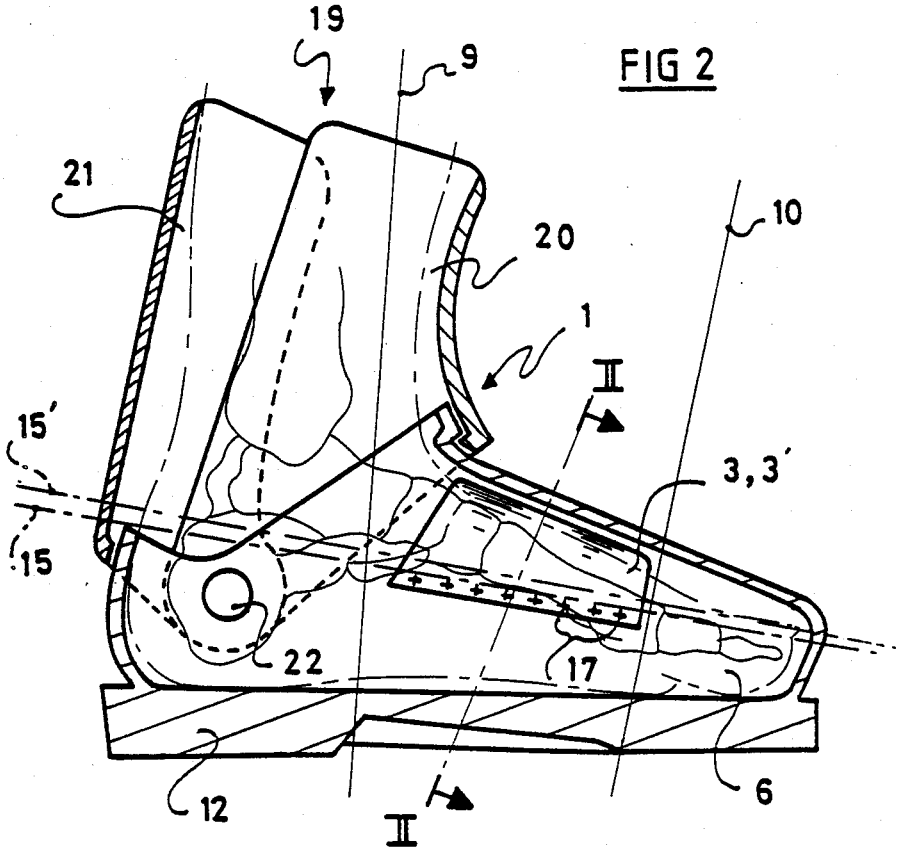
FIGS. 2 and 3 are sectional views of the boot of FIG. 1 illustrating constructional details of foot-retention means consisting of two transverse tongues.
Figure 3:
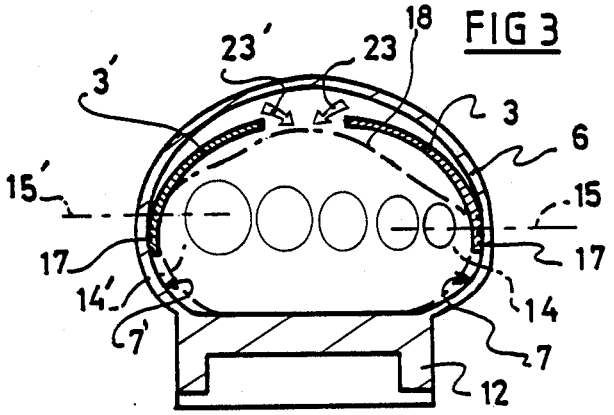

FIGS. 1, 2, and 3 illustrate a rear-opening, rigid-shelled ski boot 1 provided with an internal foot retainer comprising transverse tongues (3), (3') for holding the foot in place. Said transverse tongues (3), (3') are connected to shell base (6) on each of its inner sides (7), (7') and extend over both sides of the skier's foot (8), more or less covering the top of the foot. According to the invention, the tongues (3), (3'), considered in the longitudinal direction of the boot (1), lie between two secant planes (9) and (10) that intersect the plane (11) of the sole (12) of the boot. FIG. 1 shows that said planes (9) and (10) pass through the foot at the heads of the malleolian bones (13), (13') and of the metatarsal bones (14), (14'), respectively In this embodiment of the invention, tongues (3), (3') can be drawn down With respect to the corresponding wall of the shell base (6) beyond a delimiting line (15), (15'), below which the bony areas of the calcaneum (16) and the metatarsal heads (14), (14') of the foot (8) are housed within said shell base (6), such that said tongues (3), (3') exert no tightening effect on said bones.

FIG. 3 is a schematic representation, along plane (10), of the contour (18) of the foot showing the position of the heads of the first metatarsal bone (14) and of the fifth metatarsal bone (14') with respect to the corresponding lines of delimitation (15), (15'). It will be noted that these lines are located at different distances above the plane of the sole (!2) and correspond essentially to the positions of each of the external metatarsal heads of the foot.

The connection of the tongues (3), (3') to the shell base (6) welding, stitching, or some other fastening means.

In the construction of the boot (1), the shell of the boot consists of three major rigid parts: an oversleeve (20) and a rear cover (21), which together constitute the boot upper (19), and a lower section, or shell base (6), which contains the elements which form the object of the invention and which have just been described. An axis (22) consisting in practice of rivets serves as a hinge for the rear cover and/or the oversleeve. Known means (see FIG. 17) for adjusting tongues (3), (3'), such as lacing, tension buckles, etc., are provided on the exterior of the boot in order to enable the free ends of said tongues (3), (3') to be drawn down against the top of the foot, as shown in FIG. 3 by the direction of the arrows (23), (23'), thereby ensuring the actual retention of the foot.

FIGS. 4 through 6 illustrate various embodiments of the connection of a tongue to the sides of the shell base. In these figures, each tongue consists of an extension of the material forming the surface of the shell base into the space formed by the latter. Thus, in the example of FIG. 4, tongues (25), (25) and formed and emerge beyond delimitation lines (15) and (15'), respectively. Said lines (15), (15') divide the lateral walls of the shell base (6) into two longitudinal sections of which the one (26), (26'), adjacent to sole (12) is designed to house the base of the foot in a rigid enclosure capable of withstanding the directional forces of skiing, while the other (27), which joins lines (15) and (15') above the foot, is designed to envelop the top of the foot and, if necessary, to share in absorbing the stresses exerted on the boot top by the bending movements of the skier's leg.

Advantageously, the upper section (27) is also non-deformable but divides above said lines (15), (15') into two lateral portions forming said transverse tongues (25), (25'). The tongues are made of the same material as the walls of the shell base (6) but are generally thinner than sections (26) and (27) of the shell base in order to enable them to bend and/or to conform to the top of the foot under the effect of an actuating means.

In FIG. 5, a constructional variant shows the tongues (28), (28') that likewise consist of an extension of material within a shell base (30) above drop lines (15) and (15'). The bending and flexing capacity of said tongues (28), (28') with respect to the wall (29), (29') of said shell base (30) is obtained in this embodiment through grooves (31), (31') that constitute a zone of articulation on each of the inner Walls (32), (32') of the lower, rigid section of the shell base. In FIG. 6, the shell base (33) comprises tongues (34), (34') which consist, as in the construction shown in FIG. 4, of extensions of the material of walls (35), (35') of the shell base aboVe drop lines (15), (15'). However, in FIG. 6, the ends (36) (36') of the tongues (34), (34') extend toward each other and partially overlap.

The embodiment shoWn in FIG. 7 involves a shell base (37) comprised of two parts (38) and (39). The lower part (38), (38') comprises tongues (40), (40'), while the upper part (39) forms a rigid closable cover. The two shell pieces are joined by assembly means consisting of snap-in edges (41), (41') cooperating with grooves (42), (42') of complementary shape formed in parts (38) and (39), respectively. Preferably, the area of the seam is in the immediate proximity of drop lines (15), (15'), thus delimiting the bend zone of the transverse tongues as an area of reduced thickness (43), (43'). To meet the operational needs of this internal foot-retention system, the tongues are thin enough to ensure good flexibility, thereby facilitating their conformation to the shape of the top of the foot.

Figure 8:
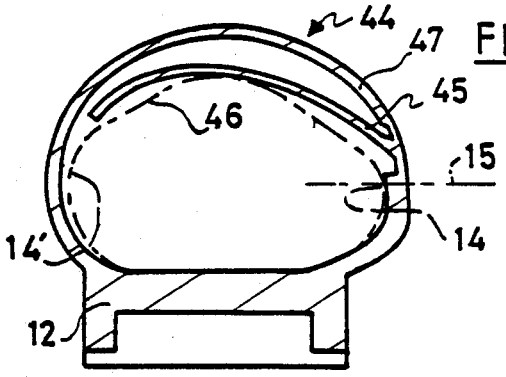

FIG. 8 illustrates a variant of the internal foot-retention means which applies to a shell base (44) having only one tongue (45). The latter extends far enough to cover, at least partially, the upper surface (46) of the foot. Obviously, tongue (45) yields to the effect of the tightening means only with respect to wall (47) of the shell base (44). Here, too, the drop line (15) above which tongue (45) may bend is located at a level that is noticeably higher than that of the heads of the metatarsal bones (14), (14').

Figure 9:
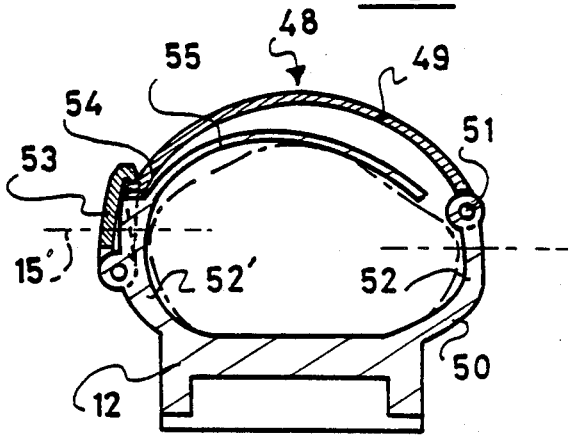

Again with respect to a design involving a single tongue (55), FIG. 9 illustrates a variant along the lines of FIG. 7 in which the shell base (48) is constructed of two parts. In this case, the top cover (49) is articulated at one side (52) of the lower section (50) of said she)1 bottom adjacent to sole (12). The articulation is effected by means of a hinge (51). A catch device (53) or the like is provided on the other side (52') of the lower section of the shell base so as to snap over a rim (54) forming the edge of cover (49) and so lock said cover over the skier's foot.

Figure 10:
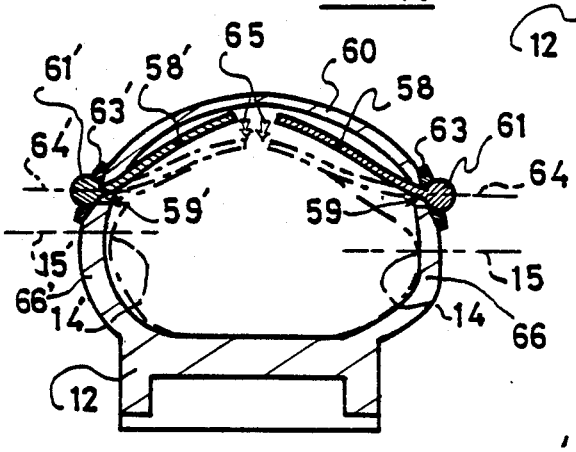

However, the invention is not limited to tongues that are connected to the shell base through a molded extension of a piece With the sides of the shell base. Embodiments also exist using various means of assembling said transverse tongues within the shell base. FIG. 10 shows one such system for anchoring the tongues in which a sort of hinge is formed along the drop lines (15), (15') that separate the flexible tongues from the shell base. In this case, tongues (58), (58') are connected to the shell base (60) by means of cylindrical stops (61), (61') functioning in conjunction with correspondingly shaped recesses formed in each of the walls (66, 66') of said shell base. At the bottom of said recesses, which are provided with seals (63), (63'), are slots (59), (59') sized to match the thickness of the tongues so that said tongues may be removably inserted into the shell base from the outside of the boot. In order to limit the insertion of the tongues into the shell, the slots must obviously be smaller than the recesses into which the cylindrical stops may be clipped and from which they may be removed, thus allowing interchangeability if repairs are needed. Advantageously, the slots will be formed at a certain angle so as to guide insertions into the shell base in such a way that, when at rest, the tongues will be oriented upward within the shell base. So arranged, the tongues (58), (58') are provided with a certain degree of mobility in the direction of the top of the foot, as indicated by arrows (65). In this example, the drop line (64), (64') of the tongues may be located above the limit line (15), (15') below which lie the heads of the metatarsal bones (14), (14').

Figure 11:
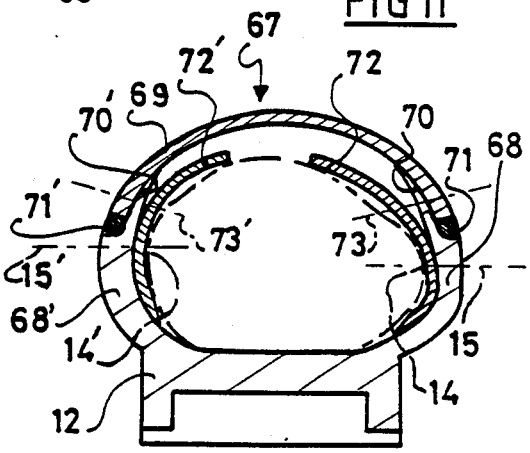

FIG. 11 illustrates a shell base (67) consisting of two sections: a lower portion (68), (68') and an upper portion or cover (69). Seal lips (70), (70') are formed from extensions of the sides of the lower section (68), (68') and cooperate with cover (69). A seal (71), (71') placed at the joint between the two lower sections (68), (68') and the cover (69) of the shell base reinforces its leakproof qualities and/or the strength of the assembly. In this example, the tongues (72), (72') are connected to the lower section (68), (68') of the shell base and are fastened to it by various assembly means known per se and hence omitted from the drawing for the sake of clarity. According to the invention, the tongues adhere to the inner wall of the shell base at least up to the drop line (73), (73'), which be coextensive with or offset from the line (15), (15') delimiting the rigid zone that houses the heads of the bones (14), (14') of the foot which serve as points of reference for the structure which is the object of the invention.

FIGS. 12 to 16 illustrate various embodiments of the tongues as well as several possible arrangements of the latter along a drop line extending laterally along various types of ski boot shell bases.

Figure 12:
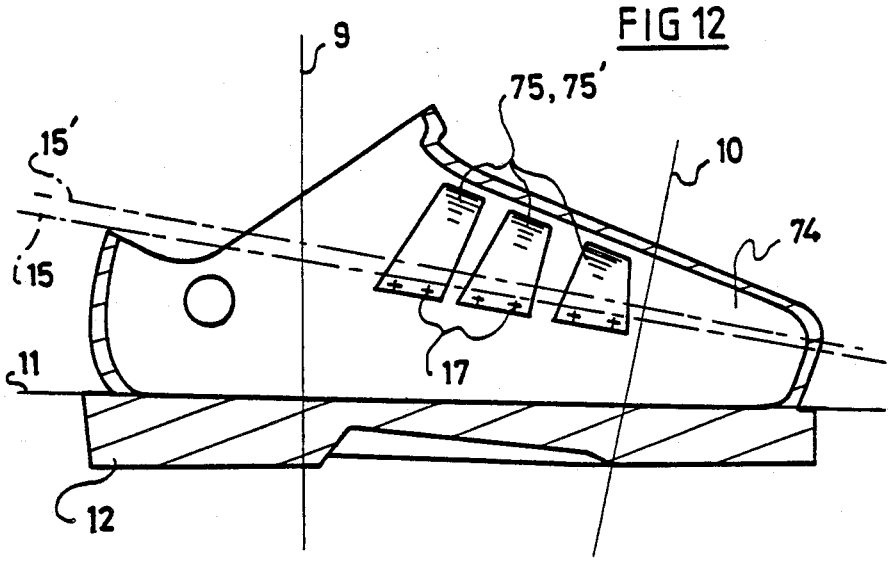
FIGS. 12 to 15 illustrate several examples of shapes and arrangements of the internal foot-retention means of the invention, viewed along the drop line.

In FIG. 12 each side of the shell base (74) comprises three tongues (75), (75') situated, in the longitudinal direction of the boot, between planes (9) and (10) that intersect plane (11) of sole (12). Their points of attachment (17) to the shell (74) are noticeably lower than the drop line (15), (15') below which are housed the metatarsal bones and the calcaneum (not shown). The foot is therefore held within the shell base in at least three gripping zones distributed over the top of the foot. These correspond the tongues (75), (75'), with each tongue adapting to the shape of the area of the foot it covers.

Figure 13:
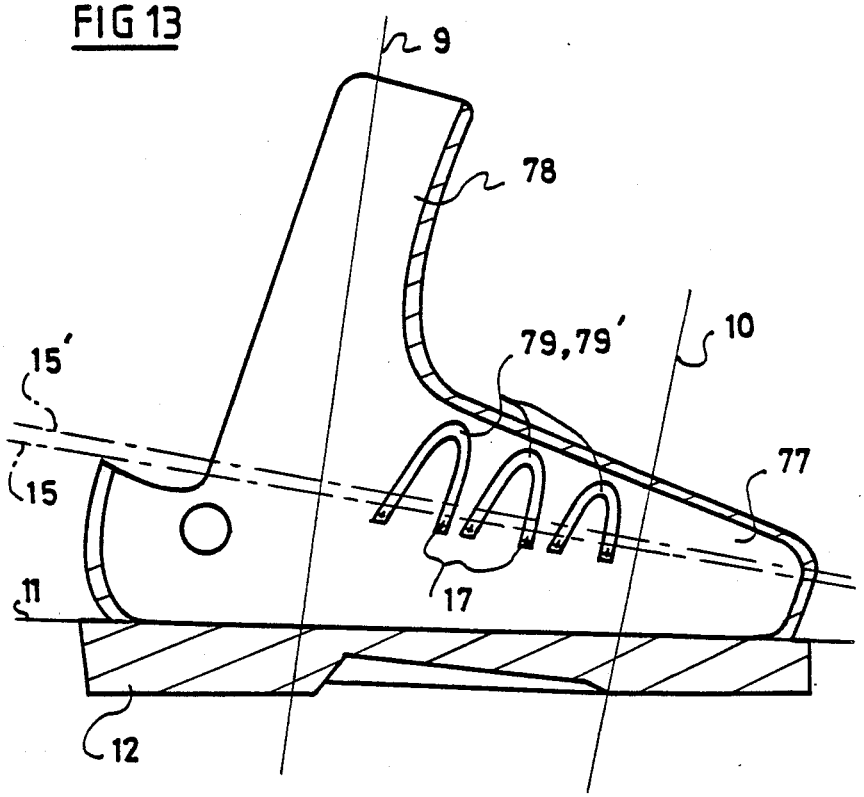

In FIG. 13, shell base (77) includes a vertical extension over the area corresponding to the skier's leg. This extension forms the oversleeve of the boot top. As in the case of the preceding figure, three tongues (79), (79') are fastened to both sides of the shell base (77) at attachment points (!7). In order to encourage the tongues (79), (79') to conform to the shape of the top of the foot they cover, said tongues are formed in the shape of flattened half-rings, each of which is capable of at least partial deformation as it is drawn down over the corresponding area of the top of the foot.

Figure 14:
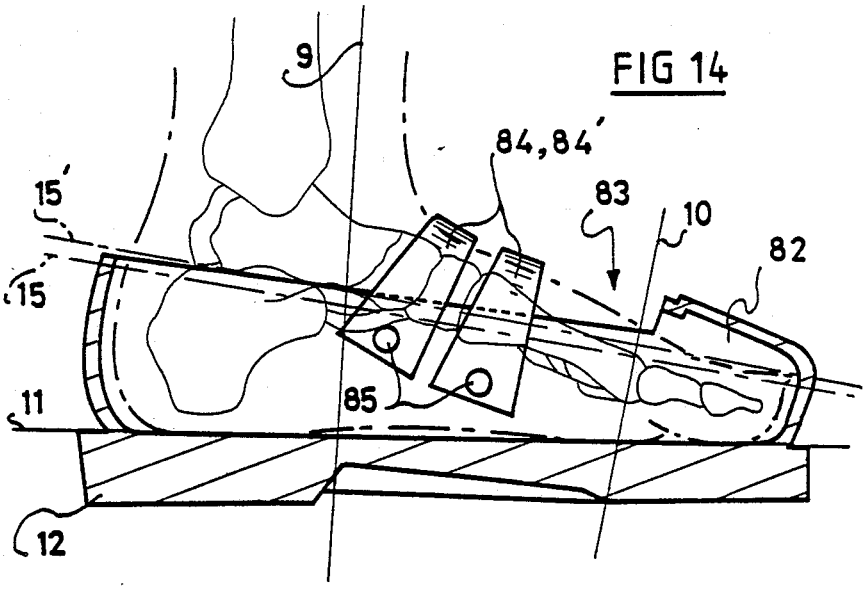

In the example illustrated in FIG. 14, the shell base (82), designed for a rear entry boot, comprises an antero-superior opening (83) designed to be closed over the forefoot with a top cover that is not shown but that may be similar to the structure described in relation to FIG. 9 or 11. Two pairs of tongues (84), (84') are connected to both sides of the shell base (82) in an area of the boot situated, according to the invention, within the limits of attachment of said transverse tongues to the shell base. In this example, tongues (84), (84') are so mounted that each is pivotable on an axis (85) provided in each of the lateral walls of the shell base, thus allowing the tongues to adjust morphologically to different types of feet. It will be noted that, in this figure, the end of the plane is situated behind (toward the heel) the metatarsal heads of the foot.

Figure 15:
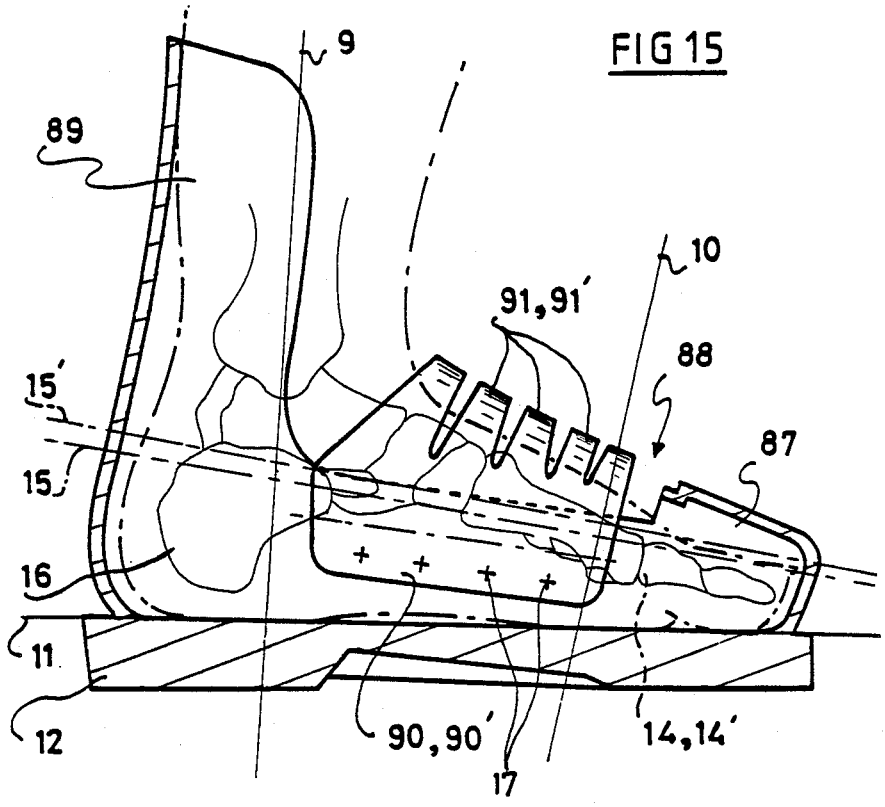

FIG. 15 illustrates a shell construction intended for a front entry boot provided With a rear top (89) that is unitary with said shell base (87). As in the construction shown in FIG. 14, this boot is designed to have a cover (not shown) intended to form an antero-superior opening (88) of the shell base. Inner transverse tongues (90), (90') for holding the foot are connected to both sides of the shell base. Provided with a number of flexible indentations (91), (91'), said tongues are designed to conform to that portion of the top of the foot that they each cover, bending approximately along limit line (15), (15'). The means (17) for attaching said tongues are placed under that line.

Figure 16:
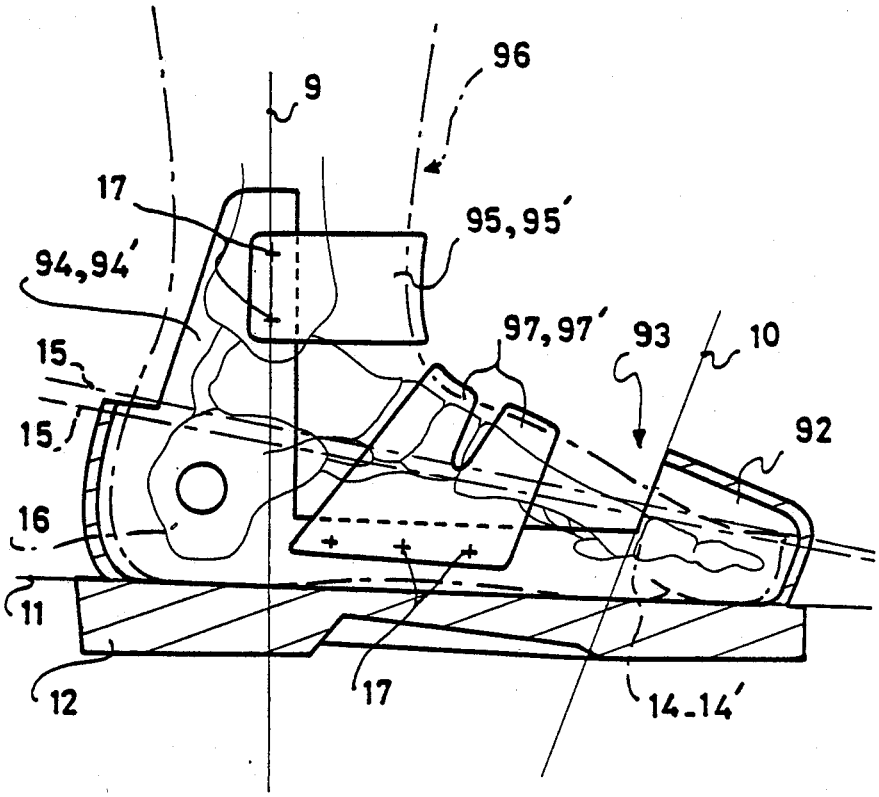
FIG. 16 illustrates a further embodiment of the internal foot-retention means according to the invention.

FIG. 16 illustrates another embodiment of the invention. The shell base (92), having a top opening (93), comprises two vertical extensions (94), (94') that extend laterally as approximate extensions of the malleoli, along the axis of the lower leg. Each of these extensions (94), (94') supports tongues (95), (95') the free ends of which cover, at least partially, the anterior portion of the skier's lower leg (96). Tongues (95), (95') and (97), (97'), designed to hold the lower leg and the foot, respectively, are connected, in this case, to the vertical lateral extensions (94), (94') of the shell base in an area included Within the limits defined by the plane (9) passing through the heads of the malleoli, and to both sides of the shell base (92). Said tongues (95), (95') and (97), (97') are flexible and pliable with respect to the walls of the shell base, both along limit line (15), (15') and within the space formed between planes (9) and (10), with the result that neither the heads of the metatarsal bones (14), (14') nor those of the calcaneum (16) are subjected to pressure or constraint when the tongues are adjusted to hold the foot.

Tongues of a size or shape different from those set forth above fall within the scope of the invention. Likewise, said tongues may or may not be arranged symmetrically on the sides of the shell base.

Any system of adjustment or tightening may be used to draw the tongues against the foot so as to retain it. Such systems may include those using cords and levered clasps, winders, or guided lacing.

Similarly, a single tongue may be connected at one of its ends to the shell base and may include appropriate fittings and/or have a structure capable of ensuring its adaptability to the morphology of the foot within a given foot-retention zone lying between planes (9) and (10) intersecting plane (11) of the sole. Finally, said internal foot-retention means is easily adaptable to all types of boot regardless of how the boots are to be put on.

What is claimed is:

1. Ski boot comprising a rigid shell base below a top portion of a boot and provided with an opening and closing system to allow a foot of a skier to be inserted, said shell base having inner sides and at least partially enveloping said foot from a front end of said boot to approximately the area corresponding to an instep of said foot, said boot comprising (a) at least one tongue (3, 3'), (25, 25'), (28, 28'), (34, 34'), (40, 40'), (45), (55), (58, 58'), (72, 72'), (75, 75'), (79, 79'), (84, 84'), (90, 90'), (97, 97') transverse with respect to a longitudinal axis of said boot, said at least one tongue being integral with at least one of said inner sides of said shell base (6), (27), (30) (33), (37), (44), (48), (60), (67), (74), (77), (82), (87), (92), and at least partially surrounding the top of said skier's foot, said tongue being adapted to fold down with respect to said shell base along a drop line (15, 15') that is longitudinal to said boot and elevated with respect to a plane (11) of a sole (12) of said boot, in a plane that passes approximately over heads of bones of said foot corresponding to metatarsals (14, 14') and approximately under heads of bones of said malleoli (13, 13'), respectively, and limited along the length of said foot by two planes (9, 10) secant to said plane of said sole and passing through said heads of said bones (13, 13'; 14, 14') respectively; and (b) tensioning means coupled with said transverse tongue and located on an exterior of said boot so as to actuate said tongue with respect to said foot once said foot is in said boot.

2. Ski boot according to claim 1, where said transverse tongue (45 (45') is integral with an inner side (47), (52') of said boot.

3. Ski boot according to claim 1, wherein said boot comprises at least two transverse tongues (3, 3'), (25, 25'), (28, 28'), (34, 34'), (40, 40'), (58, 58'), (72, 72') integral with both lateral sides (7, 7'), (26, 26'), (27, 27'), (35, 35'), (38, 38'), (66, 66'), (68, 68') of said shell base.

4. Ski boot according to claim 3, wherein said boot comprises a series of lowerable transverse tongues (75, 75'), (79, 79'), (84, 84'), (91, 91'), (97, 97') arranged along a drop line (15, 15').

5. Ski boot according to claim 1, wherein said drop line (15, 15') takes the form of a hinged structure.

6. Ski boot according to claim 5, wherein said hinged structure consists o! a bend zone (31, 31'), (43, 43') that is thinner than said tongue.

7. Ski boot according to claim 1, wherein said transverse tongue (25, 25'), (28, 28'), (34, 34'), (40, 40'), (45), (55) is unitary with a lower part of said shell base (27), (30), (33), (37), (44), (48), of which it constitutes an extension within said shell base.

8. Ski boot according to claim 1, wherein at least one tongue (3, 3'), (72, 72'), (75, 75'), (79, 79'), (90, 90'), (97, 97') is attached to a loWer part of said shell base by assembly means (17) such as glue, welds, stitches, or rivets.

9. Ski boot according to claim 8, wherein said assembly means (17), (85) are arranged along a drop line (15, 15').

10. Ski boot according to claim 9, Wherein said assembly means are swivel rivets (85) enabling said tongues (84, 84') to be morphologically oriented to said foot.

11. Ski boot according to claim 5, wherein sad hinged structure consists of a ball hinge (61, 61').

12. Ski boot according to claim 11, wherein said ball hinge (61, 61'), (63, 63') is positioned on the outside of said shell (60) of said boot, which is provided With slots (59, 59') for the removable insertion of transverse tongues (58, 58') into a space contained within said shell base.

13. Ski boot according to claim 1, wherein the lateral sides (7, 7'), (26, 26'), (29, 29'), (35, 35'), (38, 38'), (66, 66'), (68, 68') of said shell base below a drop line (15, 15') are thicker than said tongue.

14. Ski boot according to claim 1, Wherein all of the walls of said shell base adjacent to a drop line (15, 15') and said secant planes (9) and (10) are rigid and non-deformable.

15. Ski boot according to c)aim 1, wherein said shell base (6), (30), (44), (60) consists of a single molded piece.

16. Ski boot according to claim 1, wherein said shell base (37), (48), (67) consists of at least two assembled parts including a top cover (39), (49), (69) which envelopes the upper, anterior part of said foot.

17. Ski boot according to claim 16, including seal means (71, 71') between said top cover (69) and a lower section (68, 68') of said shell base.

18. Ski boot according to claim 1, wherein said transverse tongue is made of flexible material.

19. Ski boot according to claim 18, wherein free ends of said transverse tongues located within and at both sides of said shell base overlap at least partially over the top of said foot when in their position of use.

20. Ski boot according to claim 1, wherein free ends of said transverse tongues inside said shell base are provided with means for anchoring and fastening said tensioning means.

21. Ski boot according to claim 1, wherein said shell base (92) comprises two vertical and symmetrical extensions (94, 94') extending vertically !rom a heel area of said boot on either side of an axis of a leg of the skier, at least one of said extensions comprising a transverse tongue (95, 95') capable of bending above a drop line contained in one of said secant planes (9).

22. Ski boot according to claim 16, wherein said top cover (39) comprises a snap-in edge (41; 41') cooperating with grooves (42; 42') in a portion (38) of said shell base (37).

23. Ski boot according to claim 20, wherein said anchoring and fastening means comprises guided lacing.

* * * * *